US010881187B2

(12) United States Patent
Jeong et al.

(10) Patent No.: US 10,881,187 B2
(45) Date of Patent: Jan. 5, 2021

(54) FINGER INSERTION MASCARA CONTAINER PROVIDED WITH ELASTIC SLIT PART

(71) Applicant: AMOREPACIFIC CORPORATION, Seoul (KR)

(72) Inventors: Hae Won Jeong, Seoul (KR); Hyun Woo Roh, Seoul (KR); Eun Sil Han, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 271 days.

(21) Appl. No.: 15/737,234

(22) PCT Filed: Jul. 5, 2016

(86) PCT No.: PCT/KR2016/007216
§ 371 (c)(1),
(2) Date: Dec. 15, 2017

(87) PCT Pub. No.: WO2017/007210
PCT Pub. Date: Jan. 12, 2017

(65) Prior Publication Data

US 2018/0168319 A1 Jun. 21, 2018

(30) Foreign Application Priority Data

Jul. 6, 2015 (KR) ..... 10-2015-0096129

(51) Int. Cl.
*A45D 40/26* (2006.01)
*A45D 34/04* (2006.01)

(52) U.S. Cl.
CPC ..... *A45D 40/264* (2013.01); *A45D 34/04* (2013.01); *A45D 2200/10* (2013.01)

(58) Field of Classification Search
CPC ..... A45D 40/264–265; A45D 40/267–268; A45D 34/04; A45D 34/042; A45D 34/043;
(Continued)

(56) References Cited

U.S. PATENT DOCUMENTS 4,213,472 A * 7/1980 Gueret ..... A45D 40/26 132/320
5,899,622 A 5/1999 Gueret
(Continued)

FOREIGN PATENT DOCUMENTS

JP 2005-111959 A 4/2005
KR 2020000028261 Y1 3/2001
(Continued)

*Primary Examiner* — Rachel R Steitz
*Assistant Examiner* — Brianne E Kalach
(74) *Attorney, Agent, or Firm* — Heedong Chae; Lucem, PC

(57) ABSTRACT

The present invention relates to a finger insertion mascara container which is provided with an elastic slit part and has a structure wherein: a packing is coupled to the opening of a container body, in which mascara is accommodated; a wiper having a corrugated tube is coupled under the packing; a finger insertion member having a finger insertion space and also having a brush wand coupling extension part at the lower side thereof is coupled to the inside of the wiper having the corrugated tube; and a brush wand provided with a brush is coupled to the brush wand coupling extension part. The finger insertion mascara container provided with an elastic slit part allows a user to apply a cosmetic without holding a container lid with a hand, and can prevent the brush from being dropped carelessly by the user and contaminated.

8 Claims, 9 Drawing Sheets

(58) Field of Classification Search
CPC ... A45D 34/045; A45D 34/046; A45D 34/047
See application file for complete search history.

(56) References Cited

U.S. PATENT DOCUMENTS

| | | | | |
|---|---|---|---|---|
| 6,505,631 | B2 | 1/2003 | Fischer et al. | |
| 6,997,321 | B2 * | 2/2006 | Young | A45D 40/24 132/294 |
| 7,044,669 | B2 | 5/2006 | Winckels et al. | |
| 7,186,044 | B2 | 3/2007 | Bailly | |
| D615,304 | S * | 5/2010 | Cole | D4/103 |
| 8,662,091 | B2 * | 3/2014 | Jang | A46B 5/04 132/294 |
| 8,851,775 | B2 | 10/2014 | Jacob et al. | |
| 2009/0028627 | A1 * | 1/2009 | Gueret | A45D 34/046 401/122 |
| 2011/0293352 | A1 * | 12/2011 | Kim | A45D 34/043 401/122 |
| 2014/0205358 | A1 * | 7/2014 | Pschirer | A45D 40/262 401/126 |

FOREIGN PATENT DOCUMENTS

| | | | |
|---|---|---|---|
| KR | 20-0446791 | Y1 | 12/2009 |
| KR | 20-0459829 | Y1 | 4/2012 |
| KR | 10-1305631 | B1 | 9/2013 |

* cited by examiner

FINGER INSERTION MASCARA CONTAINER PROVIDED WITH ELASTIC SLIT PART

CROSS-REFERENCE TO RELATED APPLICATION

This application claims the benefit of Korean application No. 10-2015-0096129, filed on Jul. 6, 2015 with the Korean Intellectual Property Office, the disclosure of which is incorporated herein by reference.

TECHNICAL FIELD

The present invention relates to a finger insertion mascara container provided with an elastic slit part and, more specifically, to a finger insertion mascara container which is provided with an elastic slit part and has a structure where a packing is coupled to the opening of a container body in which mascara is accommodated, a wiper having a corrugated tube is coupled under the packing, a finger insertion member having a finger insertion space and also having a brush wand coupling extension part at the lower side thereof is coupled to the inside of the wiper having the corrugated tube, and a brush wand provided with a brush is coupled to the brush wand coupling extension part. The finger insertion mascara container provided with an elastic slit part allows a user to apply a cosmetic without holding a container lid with a hand, since the user uses the finger insertion mascara container with a finger inserted in the finger insertion space, when applying the cosmetic to eyelashes, and can prevent the brush from being dropped carelessly by the user and contaminated.

BACKGROUND ART

Color cosmetics, which are used to beautifully adorn the skin of a user by making the appearance beautiful, are classified into a base makeup used for making a skin color uniform and covering a defect and a point makeup used for partially enhancing a three-dimensional effect of a lip, eyes, or nails. The base makeup includes a makeup base, a foundation and a powder, and the point makeup includes a lipstick, an eye liner, and mascara.

The mascara is a cosmetic product which allows eyelashes to look thick and long so that it can give a clear impression, and a brush is used to apply the cosmetic material on the eyelashes.

In general, the mascara includes a brush integrally formed on a lid of a container containing a mascara cosmetic material. When a user opens the lid to use the cosmetic material, the contents are put on the brush so that the contents put on the brush may be applied to eyelashes.

However, according to the conventional mascara container, since the user has to grasp the lid by using a hand to make up eyelashes, it is difficult to apply elaborate eyelashes makeup.

In addition, when making up eyelashes, a user may carelessly drop the lid gripped in the hand so that the brush is contaminated.

To solve the above problems, there has been disclosed a structure in Korean Registered Utility Model No. 20-0218237 as shown in FIG. 1, where a finger fitting paint brush is applied to a mascara container. In detail, a male screw is formed in a lower portion of a finger fitting part where the finger insertion portion 1 is formed, and a brush handle having a brush is coupled with the male screw. Thus, since the user inserts the fingers into the finger insertion portion 1 for use without holding a painting tool with the hand, it is possible to apply elaborate makeup and prevent the risk of dropping the paining tool.

However, according to the related art, since the finger insertion portion 1 specified in size is produced, users having different thickness fingers are inconvenient to insert their fingers into the finger insertion portion 1.

To solve the above problems, there has been disclosed a structure in Korean Registered Utility Model No. 20-0459829 as shown in FIG. 1, where a thimble is formed at a lower side of an elastic support piece 2 which has a shape of a coil spring extending in a direction in which a finger is inserted, and a brush wand extending downward is provided on the thimble, and a coating member is formed on an end of the brush wand. Thus, the thimble is elastically stretchable due to the property of the material thereof, so that users having fingers different in thickness can use it.

However, according to the related art, when the coating member is used while a finger is inserted into the thimble, since the finger is fixed only by the elastic support piece 2 having the shape of a coil spring, the finger is not firmly fixed so that the coating member may shake, so it is difficult to apply elaborate makeup.

DISCLOSURE

Technical Problem

To solve the problems described above, one object of the present invention is to provide a finger insertion mascara container which is provided with an elastic slit part and has a structure, where a packing is coupled to the opening of a container body in which mascara is accommodated, a wiper having a corrugated tube is coupled under the packing, a finger insertion member having a finger insertion space and also having a brush wand coupling extension part at the lower side thereof is coupled to the inside of the wiper having the corrugated tube, and a brush wand provided with a brush is coupled to the brush wand coupling extension part. Thus, the finger insertion mascara container provided with an elastic slit part allows a user to apply a cosmetic without holding a container lid with a hand, since the user uses the finger insertion mascara container with a finger inserted in the finger insertion space, when applying the cosmetic to eyelashes, and can prevent the brush from being dropped carelessly by the user and contaminated.

Another object of the present invention is to provide a finger insertion mascara container provided with an elastic slit part, where a plurality of elastic slit parts are formed between finger fixing parts extending on an upper portion of the finger insertion member to flexibly widen a finger insertion space when the finger of one of the users having different thickness fingers is inserted into the finger insertion space, so that it is enabled to easily insert a finger into the finger insertion space regardless of the thickness of the finger. In addition, since the finger fixing part, which is widened when the finger is inserted there into, is elastically withdrawn while fixing the finger, it is possible to apply elaborate makeup without shaking when applying eyelash makeup.

Technical Solution

According to an aspect of the present invention, there is provided a finger insertion mascara container provided with an elastic slit part, which includes a container body (10)

containing a mascara liquid therein and formed on an upper portion thereof with an opening (11);

a wiper (30) installed in the opening (11) of the container body (10) to sweep the mascara liquid;

a finger insertion member (40) inserted into the wiper (30), formed therein with a finger insertion space (41), and formed on a lower side thereof with a brush wand coupling extension part (43); and a brush wand (50) coupled to the brush wand coupling extension part (43) of the finger insertion member (40) and formed on a lower side thereof with a brush (51), wherein a finger fixing part (44) extends from an upper portion of the finger insertion member (40), and an elastic slit part (45) is formed in a middle of the finger fixing part (44) to allow the finger insertion space (41) to be elastically widened and withdrawn.

In addition, the finger insertion mascara container further includes a packing (20) coupled between the opening (11) of the container body (10) and the wiper (30).

In addition, the finger insertion mascara container further includes a corrugated tube (31) formed on an outer periphery surface of the wiper (30).

In addition, the finger insertion mascara container further includes a counter-flow preventing protrusion wheel (32) formed on a lower outer periphery surface of the wiper (30) to prevent the mascara liquid from counter-flowing.

In addition, the finger insertion member (40) is formed on an inner periphery surface thereof with an anti-slip protrusion (42).

In addition, the finger insertion mascara container further includes a container lid (60) coupled to an upper portion of the container body (10).

In addition, wherein a pressing protrusion wheel (61) is formed on an inner side surface of the container lid (60).

Advantageous Effects

As described above, according to the finger insertion mascara container provided with an elastic slit part according to the present invention, the packing is coupled to the opening of the container body in which mascara is accommodated, the wiper having the corrugated tube, which is a counter-flow preventing protrusion wheel is formed on a lower side, is coupled under the packing, the finger insertion member having a finger insertion space and also having the brush wand coupling extension part at the lower side thereof is coupled to the inside of the wiper having the corrugated tube, and the brush wand provided with a brush is coupled to the brush wand coupling extension part. Thus, the finger insertion mascara container provided with an elastic slit part allows a user to apply a cosmetic without holding a container lid with a hand, since the user uses the finger insertion mascara container with a finger inserted in the finger insertion space, when applying the cosmetic to eyelashes, and can prevent the brush from being dropped carelessly by the user and contaminated.

In addition, the elastic slit parts are formed in a middle of the finger fixing part extending on the upper portion of the finger insertion member to flexibly widen the finger insertion space when the finger of one of the users having different thickness fingers is inserted into the finger insertion space, so that it is enabled to easily insert a finger into the finger insertion space regardless of the thickness of the finger. In addition, since the finger fixing part, which is widened when the finger is inserted there into, is elastically withdrawn while fixing the finger, it is possible to apply elaborate makeup without shaking when applying eyelash makeup.

BEST MODE

Mode for Invention

Hereinafter, a finger insertion mascara container provided with an elastic slit part according to an embodiment of the present invention will be described with reference to accompanying drawings.

Figure 1:
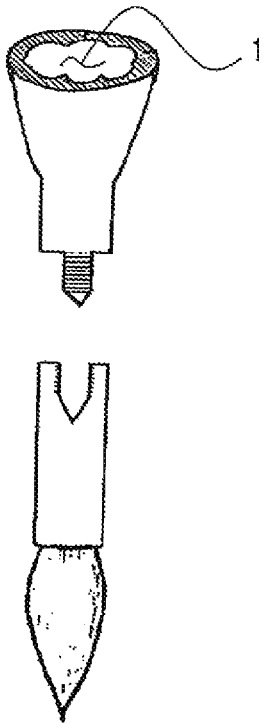
FIG. 1 is an exploded perspective view showing a brush according to the related art.
Figure 2:
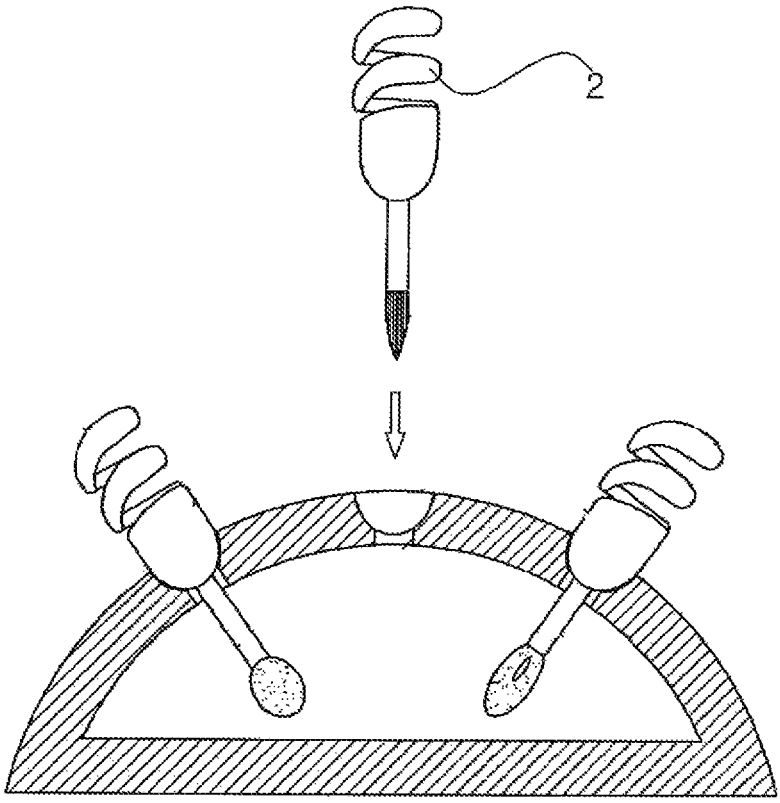
FIG. 2 is a sectional view showing a brush according to the related art.
Figure 3:
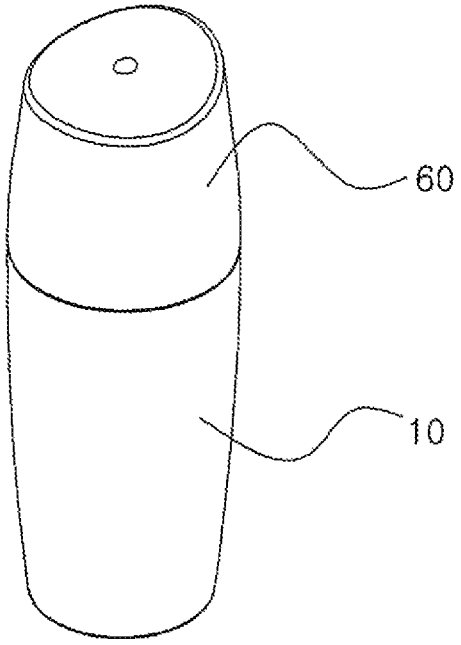
FIG. 3 is a perspective view showing a finger insertion mascara container provided with an elastic slit part according to an embodiment of the present invention.
Figure 4:
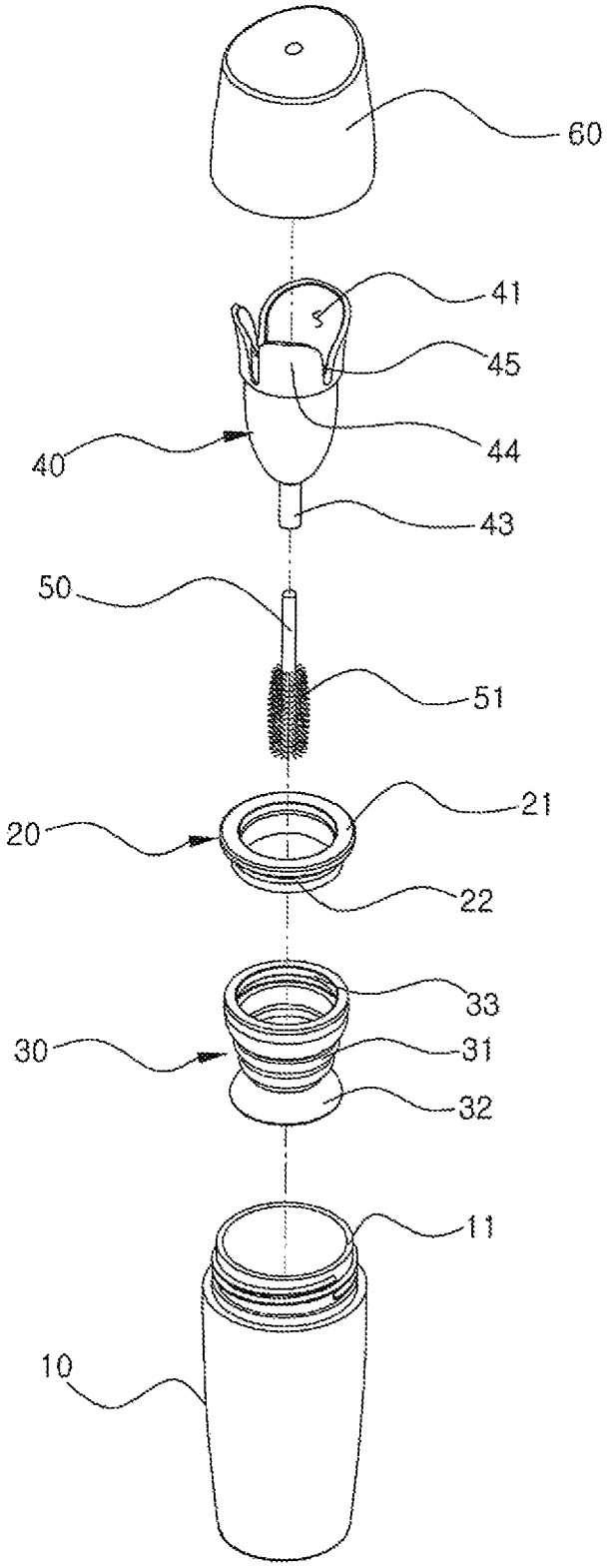
FIG. 4 is an exploded perspective view showing a finger insertion mascara container provided with an elastic slit part according to an embodiment of the present invention.
Figure 5:
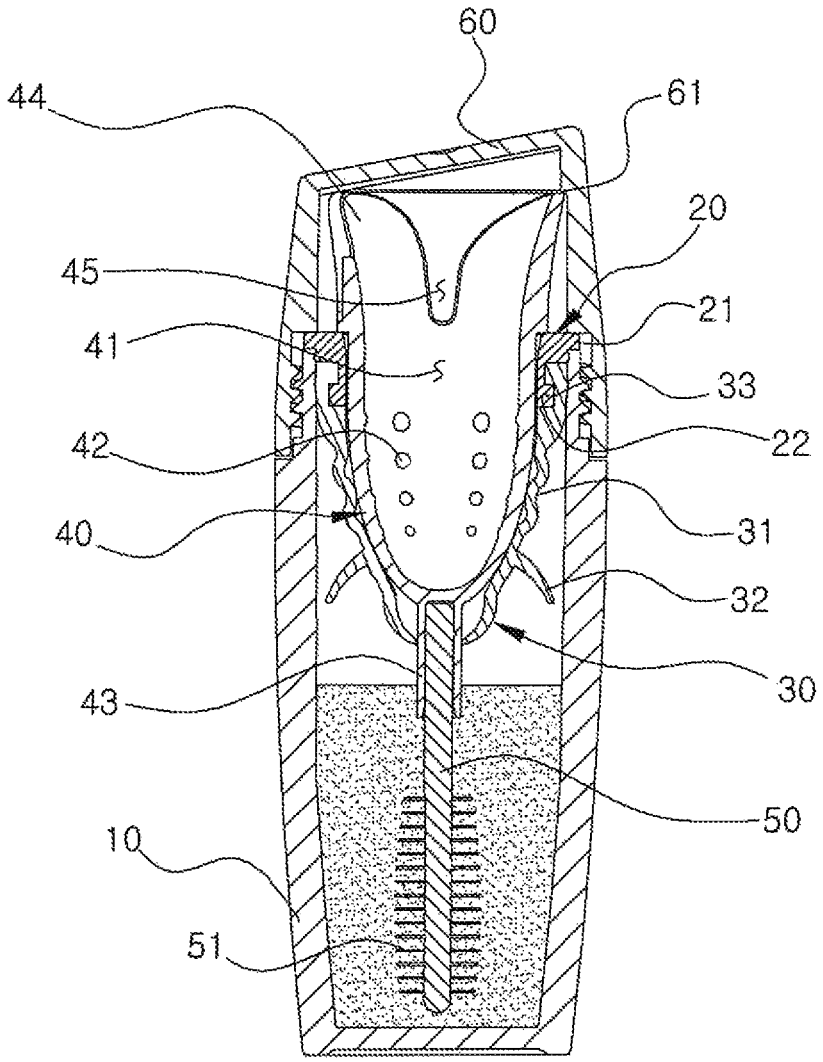
FIG. 5 is a sectional view showing a finger insertion mascara container provided with an elastic slit part according to an embodiment of the present invention.
Figure 6:
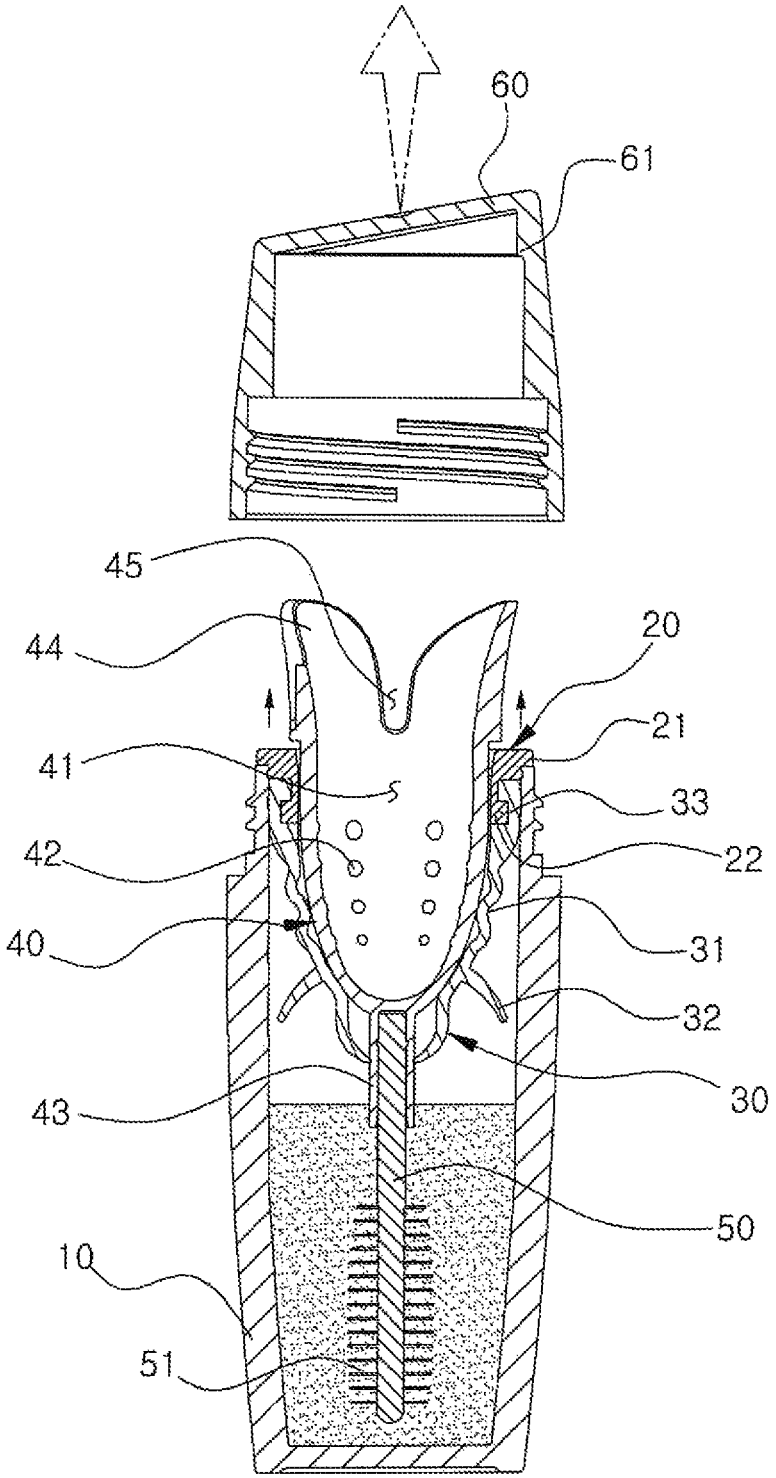
FIG. 6 is a sectional view illustrating a state in which a container lid of a finger insertion mascara container provided with an elastic slit part according to an embodiment of the present invention is separated.
Figure 7:
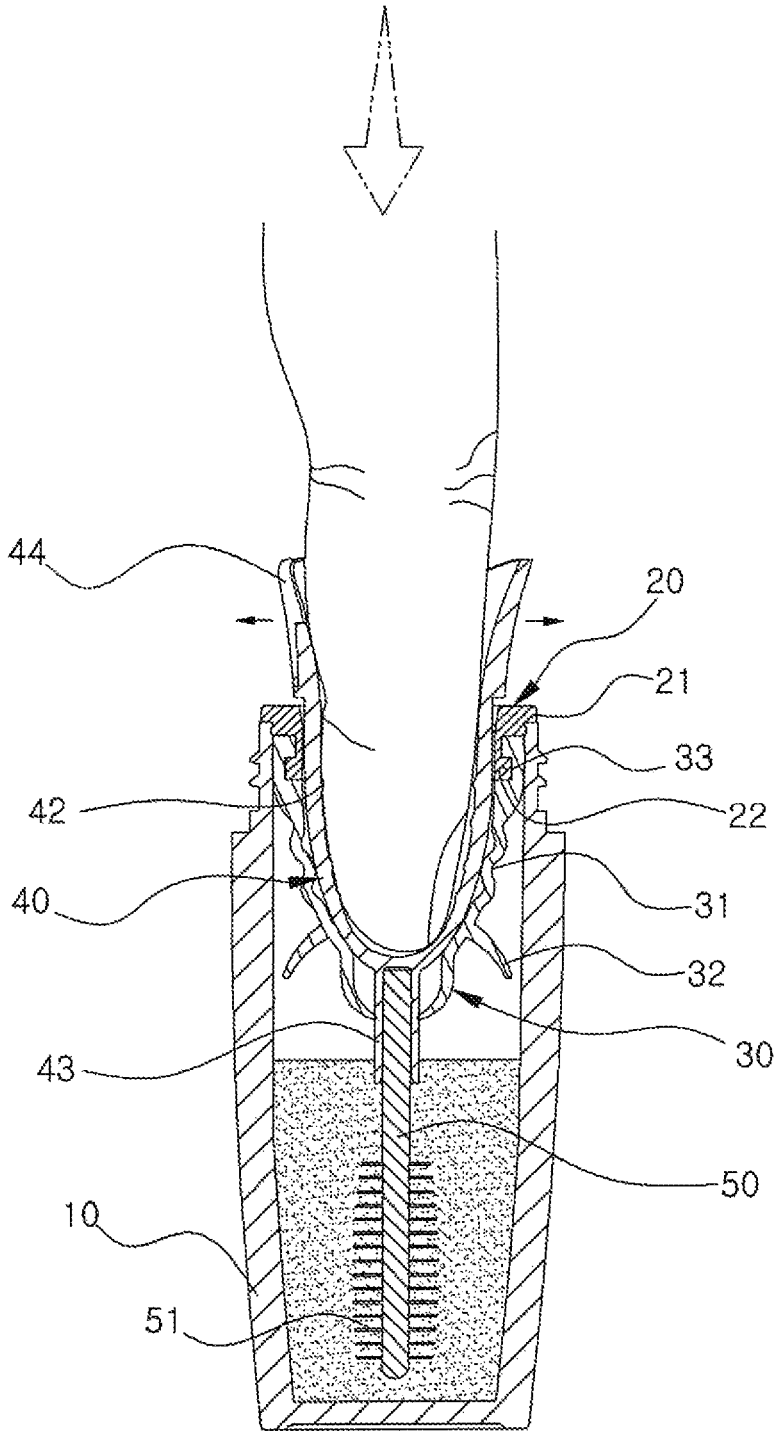
FIG. 7 is a sectional view illustrating a state in which a finger is inserted into a finger insertion member of a finger insertion mascara container provided with an elastic slit part according to an embodiment of the present invention.
Figure 8:
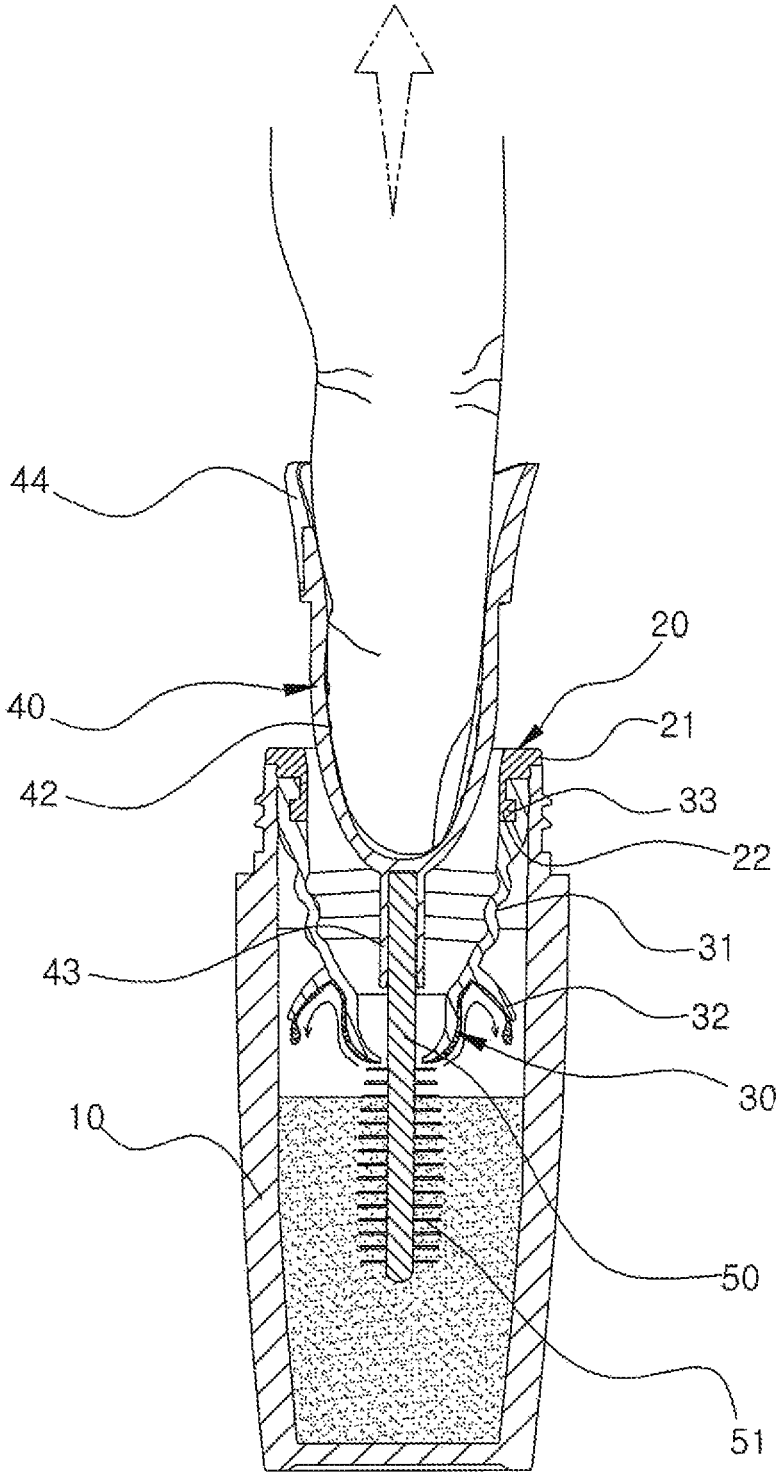
FIG. 8 is a sectional view illustrating a state in which a finger insertion member is separated by inserting a finger into a finger insertion mascara container provided with an elastic slit part according to an embodiment of the present invention.
Figure 9:
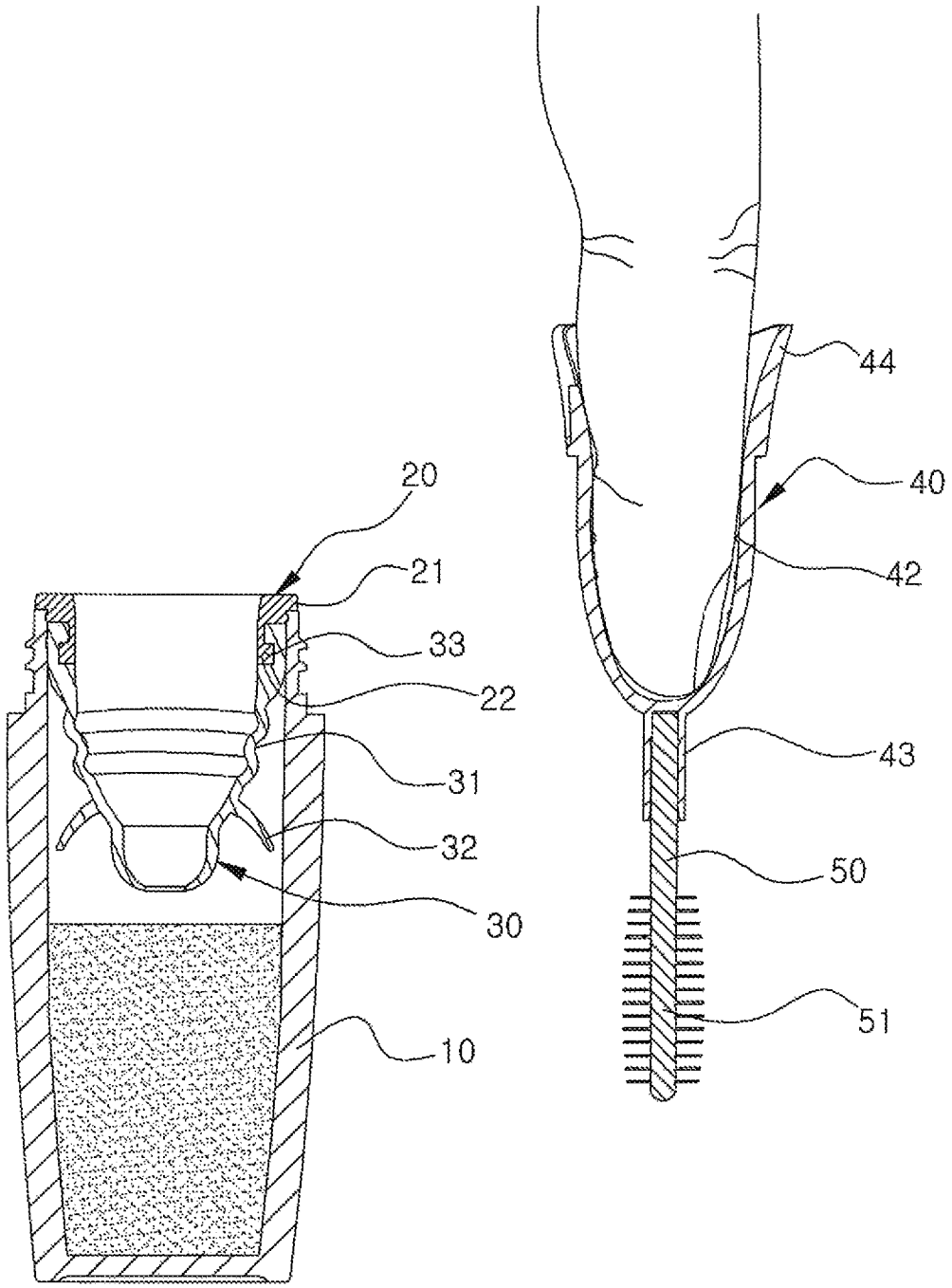
FIG. 9 is a sectional view illustrating a state in which a finger insertion member is separated by inserting a finger into a finger insertion mascara container provided with an elastic slit part according to an embodiment of the present invention.

FIG. 3 is a perspective view showing a finger insertion mascara container provided with an elastic slit part according to an embodiment of the present invention. FIG. 4 is an exploded perspective view showing a finger insertion mascara container provided with an elastic slit part according to an embodiment of the present invention. FIG. 5 is a sectional view showing a finger insertion mascara container provided with an elastic slit part according to an embodiment of the present invention. FIG. 6 is a sectional view illustrating a state in which a container lid of a finger insertion mascara container provided with an elastic slit part according to an embodiment of the present invention is separated. FIG. 7 is a sectional view illustrating a state in which a finger is inserted into a finger insertion member of a finger insertion mascara container provided with an elastic slit part according to an embodiment of the present invention. FIG. 8 is a sectional view illustrating a state in which a finger insertion member is separated by inserting a finger into a finger insertion mascara container provided with an elastic slit part according to an embodiment of the present invention. FIG. 9 is a sectional view illustrating a state in which a finger insertion member is separated by inserting a finger into a finger insertion mascara container provided with an elastic slit part according to an embodiment of the present invention.

A finger insertion mascara container provided with an elastic slit part according to the present invention includes a container body 10 containing a mascara liquid therein and formed on an upper portion thereof with an opening 11, a wiper 30 installed into the opening 11 of the container body 10 to sweep the mascara liquid, a finger insertion member 40 inserted into the wiper 30, formed therein with a finger insertion space 41, and formed on a lower side thereof with a brush wand coupling extension part 43, and a brush wand 50 coupled to the brush wand coupling extension part 43 of the finger insertion member 40 and formed on a lower side thereof with a brush 51.

The container body 10 contains mascara liquid therein and is formed on the upper end thereof with the opening 11.

The wiper 30 may be directly installed into the opening 11 of the container body 10 or installed while being coupled with a packing 20.

The packing 20 prevents the wiper 30 from being separated from the container body 10 and is preferably formed of polypropylene (PP) or polyethylene (PE).

The packing 20 is formed on an upper end thereof with a latch sill 21 and is formed on a lower outer periphery surface thereof with a coupling protrusion wheel 22.

The latch sill 21 is latch-coupled to the opening 11 of the container body 10 to prevent the packing 20 from being introduced to the inside of the container body 10.

The coupling protrusion wheel 22 is coupled with the wiper 30 and the wiper 30 is fittingly coupled between the coupling protrusion wheel 22 of the packing 20 and an inner wall of the container body 10.

The wiper 30 is coupled to the opening 11 of the container body 10 or the coupling protrusion wheel 22 of the packing 20 to sweep the mascara liquid stuck on the brush wand 50.

The wiper 30 is formed of an elastic material to be elastically stretched or withdrawn. Preferably, the wiper 30 is formed of one of natural rubber, elastomer, urethane rubber, nitrile-butadiene rubber (NBR) and silicone.

A corrugated tube 31 is formed on an outer periphery surface of the wiper 30, a counter-flow preventing protrusion wheel 32 is formed below the corrugated tube 31, and a coupling ring groove 33 is formed on an upper inner periphery surface of the corrugated tube 31.

The corrugated tube 31 is formed on the outer periphery surface of the wiper 30 and is elastically stretched to enable the mascara liquid remaining in the lower part of the container body 10 to be stuck on the brush 51 for use, so that some mascara liquid may be prevented from being residual in the container body 10.

The counter-flow preventing protrusion wheel 32 is formed below the corrugated tube 31.

As shown in FIG. 8, when the finger insertion member 40 is separated from the container body 10, the counter-flow preventing protrusion wheel 32 may prevent the mascara liquid stuck on the brush wand from moving up along the outer periphery surface of the wiper 30, so that the mascara liquid is prevented from being introduced into the space between the wipe 30 and the inner wall of the container body 10 to be solidified.

The coupling protrusion wheel 22 of the packing 20 is coupled to the coupling ring groove 33 formed on the upper inner periphery surface of the wiper 30 to prevent the wiper 30 from being separated from the inside of the container body 10.

The finger insertion member 40 is inserted into the inside of the wiper 30.

A finger insertion space 41 is formed inside the finger insertion member 40 and a brush wand coupling extension part 43 is formed on a lower side of the finger insertion member 40.

A finger is inserted into the finger insertion space 41. An anti-slip protrusion 42 is formed on the inner periphery surface to prevent the finger from slipping when the finger is inserted.

Since a user uses the finger insertion mascara container with a finger inserted in the finger insertion space 41, when applying the cosmetic to eyelashes, it is possible to apply makeup without holding the container lid 60 with his hand and to prevent the brush 51 coupled to the finger insertion member 40 from being dropped carelessly by the user and contaminated.

The brush wand coupling extension part 43 is coupled with the brush wand 50 formed with the brush 51.

The brush wand 50 may be coupled to the brush wand coupling extension part 43 and may be integrally formed on the finger insertion member 40.

A finger fixing part 44 extends from an upper portion of the finger insertion member 40 to fix the finger inserted into the finger insertion space 41.

A plurality of elastic slit parts 45 is formed in a middle of the finger fixing parts 44.

The elastic slit parts 45 allows the finger fixing part 44 to be flexibly widened when the finger of one of the users having different thickness fingers is inserted into the finger insertion space 41, so that it is enabled to easily insert a finger into the finger insertion space 41 regardless of the thickness of the finger. In addition, since the finger fixing part 44, which is widened when the finger is inserted there into, is elastically withdrawn while fixing the finger, it is possible to apply elaborate makeup without shaking when applying eyelash makeup.

A container lid 60 is further coupled to an upper portion of the container body 10.

A pressing protrusion wheel 61 is formed on an upper portion of an inside of the container lid 60. As shown in FIG. 5, the pressing protrusion wheel 61 presses the finger fixing part 44 of the finger insertion member 40 when the container lid 60 is closed.

The pressing protrusion wheel 61 presses the upper end of the finger fixing part 44 and at the same time, the wiper 30 is pushed to the lower portion of the container body 10 so that the corrugated tube 31 is stretched. Thus, the finger insertion member 40 is tightly closed to the inside of the wiper 30 to seal the container body 10 so that the mascara liquid contained in the container body 10 is prevented from volatilizing.

Hereinafter, an assembling method and a using state of a finger insertion mascara container provided with an elastic slit part according to an embodiment of the present invention will be described as follows.

According to the present invention, the packing 20 is coupled to the opening 11 on the upper end of the container body 10 and the coupling protrusion wheel 22 formed below the packing 20 is fitted into the coupling ring groove 33 of the wiper 30 to allow the wiper 30 to be coupled to a lower side of the packing 20.

In this case, the corrugated tube 31 is formed on the outer periphery surface of the wiper 30, and the counter-flow preventing protrusion wheel 32 is formed below the corrugated tube 31.

Then, the finger insertion member 40 formed inside the wiper 30 is inserted and the brush wand 50 formed with the brush 51 is coupled to the brush wand coupling extension part 43.

In addition, the container lid 60 is coupled to the upper portion of the container body 10. The pressing protrusion wheels 61 are formed on the upper inner side portion of the container lid 60. As shown in FIG. 5, when the container lid 60 is closed, the pressing protrusion wheel 61 presses the finger fixing part 44 of the finger insertion member 40 to complete the assembly.

To use the mascara liquid of the finger insertion mascara container provided with an elastic slit part assembled according to the above-described method, as shown in FIG. 6, the container lid 60 is to be opened from the container body 10.

In this case, the corrugated tube 31 of the wiper 30, which has been extended by the pressure of the container lid 60, is withdrawn so that the finger insertion member 40 moves upward.

Then, as shown in FIG. 7, a finger is inserted into the finger insertion space 41 of the finger insertion member 40 and the finger fixing part 44 extends on the finger insertion member 40. The elastic slit parts 45 are formed in a middle of the finger fixing part 44.

The elastic slit parts 45 allows the finger fixing part 44 to be flexibly widened when the finger of one of the users having different thickness fingers is inserted into the finger insertion space 41, so that it is enabled to easily insert a finger into the finger insertion space 41 regardless of the thickness of the finger. In addition, since the finger fixing part 44, which is widened when the finger is inserted there into, is elastically withdrawn while fixing the finger, it is possible to apply elaborate makeup without shaking when applying eyelash makeup.

Thereafter, as shown in FIGS. 8 and 9, the finger insertion member 40 is separated by upwardly moving the finger.

Since a user uses the finger insertion mascara container with a finger inserted in the finger insertion space 41 of the finger insertion member 40, when applying the cosmetic to eyelashes, it is possible to apply makeup without holding the container lid 60 with his hand and to prevent the brush 51 coupled to the finger insertion member 40 from being dropped carelessly by the user and contaminated.

As described above, the finger insertion mascara container provided with an elastic slit part described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Container body
11: Opening
20: Packing
21: Latch sill
22: Coupling protrusion wheel
30: Wiper
31: Corrugated tube
32: Counter-flow preventing protrusion wheel
33: Coupling ring groove
40: Finger insertion member
41: Finger insertion space
42: Anti-slip protrusion
43: Brush wand coupling extension part
44: Finger fixing part
45: Elastic slit part
50: Brush wand
51: Brush
60: Container lid
61: Pressing protrusion wheel

The invention claimed is:

1. A finger insertion mascara container provided with an elastic slit part, the finger insertion mascara container comprising:

a container body (10) containing a mascara liquid therein and formed on an upper portion thereof with an opening (11);

a wiper (30) installed in the opening (11) of the container body (10) to sweep the mascara liquid;

a finger insertion member (40) inserted into the wiper (30), formed therein with a finger insertion space (41), and formed on a lower side thereof with a brush wand coupling extension part (43);

a brush wand (50) coupled to the brush wand coupling extension part (43) of the finger insertion member (40) and formed on a lower side thereof with a brush (51); and a container lid (60) coupled to an upper portion of the container body (10), wherein a finger fixing part (44) extends from an upper portion of the finger insertion member (40), and an elastic slit part (45) is formed in a middle of the finger fixing part (44) to allow the finger insertion space (41) to be elastically widened and withdrawn, wherein a corrugated tube (31) that is elastically extendable is formed on an outer periphery surface of the wiper (30), wherein, when the container lid (60) is coupled to the upper portion of the container body (10), the corrugated tube (31) extends from pressure of the container body (10), wherein, when the container lid (60) is opened from the container body (10), the corrugated tube (31) withdraws such that the finger insertion member (40) rises upwards, wherein a pressing protrusion wheel (61) is formed on an inside of the container lid (60), and wherein, when the container lid (60) is closed, the pressing protrusion wheel (61) presses an upper end of the finger fixing portion (44) of the finger insertion member (40) and, at the same time, the wiper (30) is pushed to a lower portion of the container body (10) such that the corrugated tube (31) is stretched.

2. The finger insertion mascara container of claim 1, further comprising a packing (20) coupled between the opening (11) of the container body (10) and the wiper (30).

3. The finger insertion mascara container of claim 1, further comprising a counter-flow preventing protrusion wheel (32) formed on a lower outer periphery surface of the wiper (30) to prevent the mascara liquid from counter-flowing.

4. The finger insertion mascara container of claim 1, wherein the finger insertion member (40) is formed on an inner periphery surface thereof with an anti-slip protrusion (42).

5. A finger insertion mascara container provided with an elastic slit part, the finger insertion mascara container comprising:

a container body (10) containing a mascara liquid therein and formed on an upper portion thereof with an opening (11);

a wiper (30) installed into the opening (11) of the container body (10) to sweep the mascara liquid;

a finger insertion member (40) inserted into the wiper (30), formed therein with a finger insertion space (41), and formed on a lower side thereof with a brush wand (50); and a container lid (60) coupled to an upper portion of the container body (10), wherein a brush (51) is formed on an end of the brush wand (50), a finger fixing part (44) extends from an upper portion of the finger insertion member (40), and an elastic slit part (45) is formed in a middle of the finger fixing part (44) to allow the finger insertion space (41) to be elastically widened and withdrawn, wherein a corrugated tube (31) that is elastically extendable is formed on an outer periphery surface of the wiper (30), wherein, when the container lid (60) is coupled to the upper portion of the container body (10), the corrugated (31) tube extends from pressure of the container body (10), wherein, when the container lid (60) is opened from the container body (10), the corrugated tube (31) withdraws such that the finger insertion member (40) rises upwards, and wherein a pressing protrusion wheel (61) is formed on an upper portion of an inside of the container lid (60), and wherein, when the container lid (60) is closed, the pressing protrusion wheel (61) presses an upper end of the finger fixing portion (44) of the finger insertion member (40) and, at the same time, the wiper 30 is pushed to a lower portion of the container body (10) such that the corrugated tube (31) is stretched.

6. The finger insertion mascara container of claim 5, further comprising a packing (20) coupled between the opening (11) of the container body (10) and the wiper (30).

7. The finger insertion mascara container of claim 5, further comprising a counter-flow preventing protrusion wheel (32) formed on a lower outer periphery surface of the wiper (30) to prevent the mascara liquid from counter-flowing.

8. The finger insertion mascara container of claim 5, wherein the finger insertion member (40) is formed on an inner periphery surface thereof with an anti-slip protrusion (42).

* * * * *